US009751304B2

(12) United States Patent
Akizuki

(10) Patent No.: US 9,751,304 B2
(45) Date of Patent: Sep. 5, 2017

(54) PRINTER AND CONTROL METHOD THEREFOR

(71) Applicant: Seiko Epson Corporation, Tokyo (JP)

(72) Inventor: Masayuki Akizuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/258,827

(22) Filed: Sep. 7, 2016

(65) Prior Publication Data

US 2017/0072689 A1 Mar. 16, 2017

(30) Foreign Application Priority Data

Sep. 16, 2015 (JP) ..... 2015-182621

(51) Int. Cl.
*B41J 2/045* (2006.01)
*B41J 29/38* (2006.01)

(52) U.S. Cl.
CPC ..... *B41J 2/04573* (2013.01); *B41J 29/38* (2013.01)

(58) Field of Classification Search
CPC B41J 2/04541; B41J 2/04543; B41J 2/04573; B41J 29/38; B41J 2202/20
See application file for complete search history.

(56) References Cited

U.S. PATENT DOCUMENTS 7,588,310 B2 * 9/2009 Baek ..... B41J 29/38 347/23
8,038,249 B2 * 10/2011 Hayashi ..... B41J 2/04541 347/17

FOREIGN PATENT DOCUMENTS

JP 2004-131104 4/2004
JP 2014-172634 9/2014

* cited by examiner

*Primary Examiner* — Thinh H Nguyen
(74) *Attorney, Agent, or Firm* — Foley & Lardner LLP

(57) ABSTRACT

A printer that prints printouts processed in a post-printing process such as a label application step reduces the difference between the target time for printing completion and the actual completion of printing. When a print command is acquire-d from a control device 2, the printer 10 calculates a required printing time Tp including a time T1 required for the print preparation operation, and acquires a target time Tt for completing the specified printing. The controller 12 supplies a trigger signal for starting printing to the print unit 11 at a time calculated back from the target time Tt. The controller 12 calculates the required printing time Tp by adding the time required for the print preparation operation according to the current status of the printer 10 to the time required for the printing operation itself.

16 Claims, 4 Drawing Sheets

PRINTER AND CONTROL METHOD THEREFOR

BACKGROUND

1. Technical Field

The present invention relates to a printer that supplies printouts to a post-printing process, and to a control method of the printer.

2. Related Art

To prevent label application failures and improve the efficiency of the print and apply labelling operation in a print and apply labelling system that prints labels with a printer and then applies the printed labels to products, the printer is preferably controlled to print the labels according to the timing of the label application operation.

JP-A-2014-172634 describes a print and apply labelling system including a label printer (printer) for printing the labels, and a label applicator for applying the printed labels to product. In this print and apply labelling system the label applicator applies printed labels to the product by moving between label picking position and apply position. The system described in JP-A-2014-172634 calculates the delay until the label printer starts printing and controls the timing of label printing according to the timing of label applicator movement. This reduces the chance of the moving label applicator interfering with the printed label, causing the label to fall or become distorted and the label application operation to fail.

Calculating the delay until label printing starts in the system described in JP-A-2014-172634 considers the time required for packaging and movement of the product the label is applied to, and the time required to feed the label to the applicator. However, the print timing is not controlled with consideration for internal factors on the printer side, such as variation in the required printing time, that is, the length of the printing process including returning the print unit from the standby state waiting for the next label to the state enabling printing. As a result, when the required printing time varies due to such factors, labels may not be issued at the optimal timing and the label application operation may fail. The print and apply labelling operation may also not run efficiently because labels are not produced at the optimal timing.

SUMMARY

A printer and a printer control method according to the invention for producing printouts that are passed to a post-printing process such as a label application process reduce the difference between the target time for printing completion and the actual printing completion time.

To achieve the foregoing objective, a printer according to the invention includes a print unit configured to print on a print medium; and a control unit configured to control the print unit. When a print command is acquired, the control unit calculates a required printing time including the time from the start to the end of the printing operation printing the specified content, and the time required for a print preparation operation setting the print unit to a state able to start the printing operation, as the time required to complete printing based on the print command; acquires a target time until printing controlled by the print command is completed; and starts the print preparation operation based on the required printing time and the target time.

Another aspect of the invention achieving the foregoing objective is a control method of a printer having a print unit configured to print on a print medium, and a control unit configured to control the print unit, the control method including: a print command acquisition step of the control unit acquiring a print command; a required printing time calculating step of calculating a required printing time including the time from the start to the end of the printing operation printing the specified content, and the time required for a print preparation operation setting the print unit to a state able to start the printing operation, as the time required to complete printing based on the print command; a target time acquisition step of the control unit acquiring a target time until printing controlled by the print command is completed; and a printing start time determination step of the control unit determining the time to start the print preparation operation based on the required printing time and the target time.

These configurations calculate the required printing time including a print preparation operation each time a print command is received, and acquires a target time when printing the specified content will be completed. By thus calculating the required printing time considering the time required for the print preparation operation in addition to the time required for the printing operation itself, the difference between the target time and the time printing is actually completed can be reduced. Problems in post-printing processes to which the resulting printout is passed can therefore be suppressed, and the efficiency of the printing process and post-printing process can be improved.

A printer according to another aspect of the invention also has a communication unit, and the control unit acquires the print command and the target time through the communication unit.

This configuration supplies both the print command and target time to the printer. As a result, as soon as the required printing time is calculated for each print command, the appropriate time for starting printing can be determined by calculating back from the target time.

A printer according to another aspect of the invention also has a communication unit configured to communicate with a detection unit configured to detect products on a conveyor line, and the print medium is a label applied to a product conveyed on the conveyor line. The control unit acquires the detection signal of the detection unit through the communication unit, and calculates the target time based on the detection signal.

Because the target time is thus calculated based on the conveyance position of the product, the difference between the target time and the time the product reaches the position where the label is applied is small.

Further preferably in a control method of a printer according to another aspect of the invention, the print medium is a label applied to product conveyed on a conveyor line; and the target time acquisition step includes acquiring the detection signal of a detection unit that detects the product on the conveyor line, and calculating the target time based on the detection signal.

This configuration can calculate the target time when the product reaches the position where the label is applied based on the conveyance speed of the product to which the label is to be applied and the distance of travel from the detection position of the detection unit and the label application position to which the printed label is supplied.

In a printer according to another aspect of the invention, the control unit determines based on the required printing time if printing can be completed by the target time, and if printing cannot be completed by the target time, executes an error handling process of cancelling or postponing printing as instructed by the print command.

A control method of a printer according to another aspect of the invention also has a decision step of determining based on the required printing time if printing can be completed by the target time; and an error handling step of the control unit cancelling or postponing printing as instructed by the print command if printing cannot be completed by the target time.

These configurations can prevent printing when printing will not be completed by the target time. Printouts can therefore be prevented from being wasted because printing was not completed in time. Problems in post-printing processes resulting from printing not being completed in time can also be prevented.

In a printer according to another aspect of the invention, the print unit includes an inkjet head and a head cap configured to cap the ink nozzle face of the inkjet head; and the print preparation operation includes a cap retracting operation of retracting the head cap from the position capping the ink nozzle face.

When the printer acquires a print command while in a standby mode with the ink nozzle face capped by the head cap, the timing for starting printing can be determined to also consider the time required for the head retraction operation. The difference between the target time and the time printing is actually completed can therefore be reduced.

In a printer according to another aspect of the invention, the print unit includes a conveyance mechanism configured to convey the print medium; and the print preparation operation includes a print medium indexing operation of the conveyance mechanism.

When the printer acquires a print command while in a standby mode, the timing for starting printing can be determined to also consider the time required for the media indexing operation. The difference between the target time and the time printing is actually completed can therefore be reduced.

Further preferably in the control method of a printer in according to another aspect of the invention, the required printing time calculating step includes calculating the time required for one or both of a cap retracting operation of retracting a head cap from the cap position capping the ink nozzle face, and a print medium indexing operation of the conveyance mechanism that conveys the print medium, as the time required for the print preparation operation.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of printer and a control method of a printer according to the present invention is described below with reference to the accompanying figures.

Print and Apply Labelling System

Figure 1:
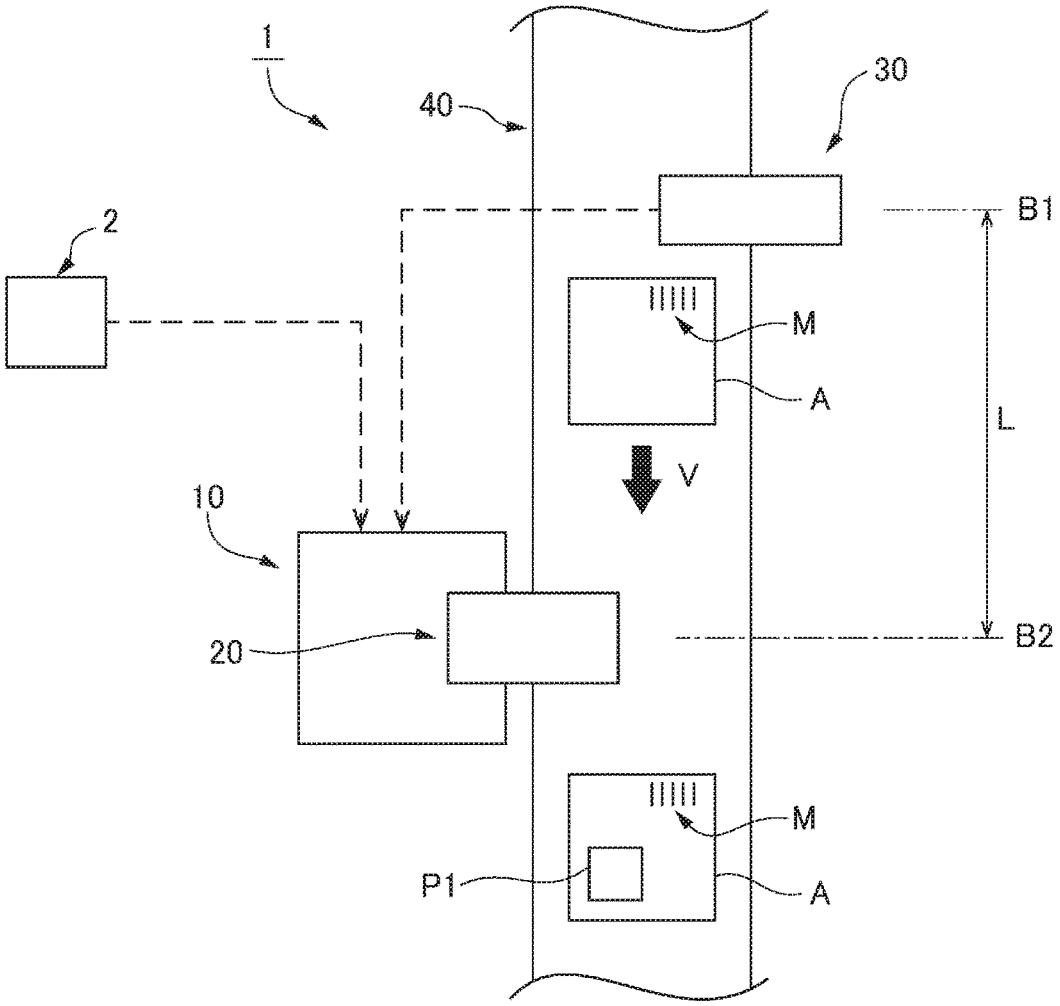
FIG. 1 illustrates a print and apply labelling system including a printer according to the invention.

FIG. 1 illustrates a print and apply labelling system including a printer according to the invention. The print and apply labelling system 1 repeatedly executes a process of printing and applying a label P1 to a product A based on commands from a control device 2.

The print and apply labelling system 1 includes a printer 10, label applicator 20, product detector 30, and conveyance line 40. The conveyance line 40 has a belt conveyor, and conveys the product A past a detection position B1 and an apply position B2. The product detector 30 detects the product A passing the detection position B1. The product detector 30 can communicate with the printer 10, and when a product A is detected, sends a detection signal to the printer 10 to report detection of the product A. In this embodiment, a barcode or other mark M is disposed to the product A, and the product detector 30 detects the product A by reading the marks M.

Figure 2:
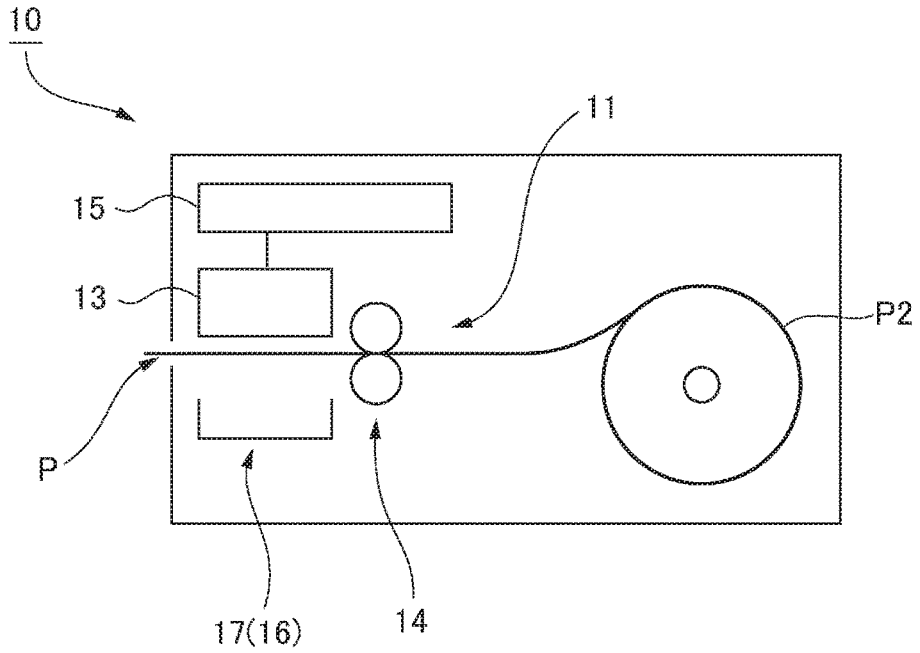
FIG. 2 illustrates the configuration of a printer according to the invention.

The printer 10 prints a label P1 based on a print command from the control device 2. Label paper having labels P1 affixed in a line to a continuous liner is loaded in the printer 10 as the print medium P (FIG. 2). The printer 10 completes printing on the label P1 to be applied to the product A and passes the printed label P1 to the label applicator 20 before the product A passes the position B2 where the label is applied (referred to herein as the apply position B2). The label applicator 20 forms a label vacuum operation to pick the printed label P1 from the print medium P discharged from the printer 10, and a label application operation of applying the picked label P1 to the surface of the product A passing the apply position B2.

Printer

Figure 3:
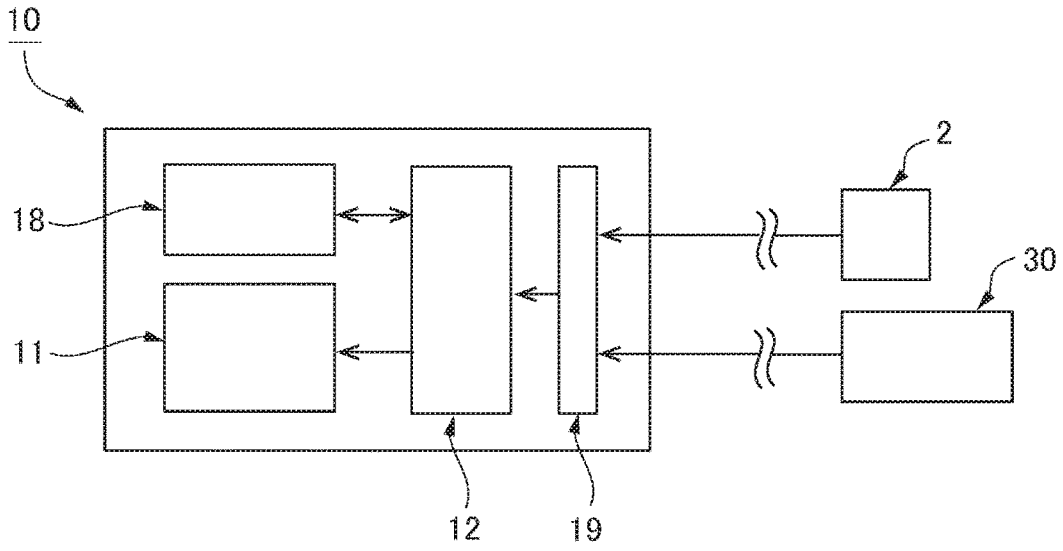
FIG. 3 is a block diagram of the control system of the printer in FIG. 2.

FIG. 2 illustrates the configuration of the printer 10, and FIG. 3 is a block diagram of the control system of the printer 10. The printer 10 includes a print unit 11, a controller 12 that controls the print unit 11, a storage unit 18, and a communication unit 19. The storage unit 18 stores data used for control by the controller 12. The controller 12 communicates with the control device 2 and the product detector 30 through the communication unit 19. The controller 12 acquires print commands from the control device 2 through the communication unit 19. The controller 12 also acquires detection signals output from the product detector 30 through the communication unit 19.

As shown in FIG. 2, a roll P2 of wound print medium P is loaded inside the printer 10. The print unit 11 includes an inkjet head 13 that ejects ink onto the print medium P, a conveyance mechanism 14 that conveys the print medium P delivered from the paper roll P2, an ink supply mechanism 15 that supplies ink to the inkjet head 13, and a cap unit 16 that caps the nozzle face of the inkjet head 13.

The conveyance mechanism 14 includes a conveyance roller pair and a conveyance motor. The controller 12 controls the conveyance mechanism 14 to convey the continuous print medium P to the inkjet head 13. The conveyance mechanism 14 executes an indexing operation to position the label P1 to be printed to the printing position of the inkjet head 13. The controller 12 controls the inkjet head 13 to eject ink and print an image on the label P1 by conveying the print medium P in conjunction with the ink ejection operation. The part of the print medium P where the printed label P1 is located is then discharged from the printer 10.

The ink supply mechanism 15 includes an installation unit where an ink cartridge or other type of ink container is installed, and an ink path through which ink flows from the installed ink container to the inkjet head 13. A buffer tank or backflow preventer, for example, is disposed to the ink path. Note that the configuration of the ink supply mechanism 15 is obviously not limited to the foregoing, and other configurations may be used. For example, a configuration having a pressure mechanism to pressurize the ink container may be used.

The cap unit 16 is disposed to a position outside the media conveyance path through which the print medium P is conveyed. The inkjet head 13 is moved by a head moving mechanism not shown between a printing position opposite the print medium P and a standby position opposite the cap unit 16. The cap unit 16 includes a head cap 17 that caps the nozzle face of the inkjet head 13, a cap elevator (not shown in the figure) that moves the head cap 17 to and away from the nozzle face, and a suction mechanism (not shown in the figure) that applies suction to the head cap 17.

When the inkjet head 13 moves to the standby position, the controller 12 controls the cap elevator to move the head cap 17 to the position capping the nozzle face. The controller 12 keeps the nozzle face capped while the inkjet head 13 is at the standby position.

The inkjet head 13 performs an ink purging operation (flushing) at specific times to remove or prevent clogging of the ink nozzles. The head cap 17 functions as a member receiving the ink discharged in the flushing operation. The controller 12 also performs a cleaning operation that suctions ink from the ink nozzles by driving the suction mechanism when the ink nozzle face is capped by the head cap 17.

Label Printing Process

Figure 4:
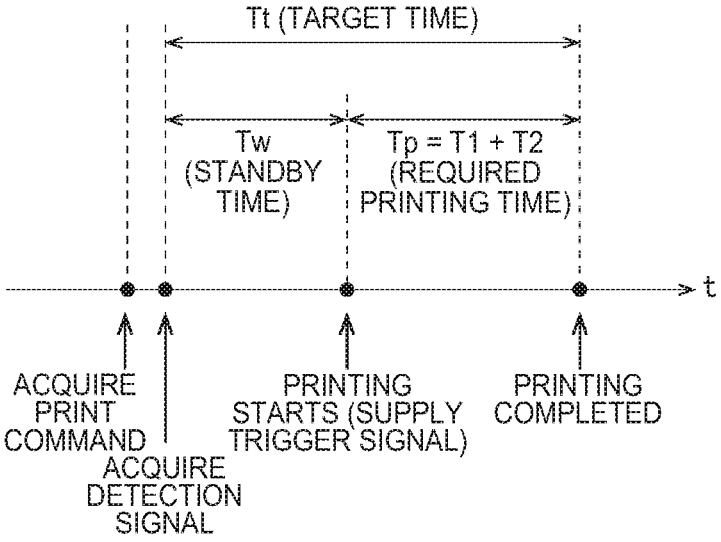
FIG. 4 is a timing chart of the printing process of the printer in FIG. 2.
Figure 5:
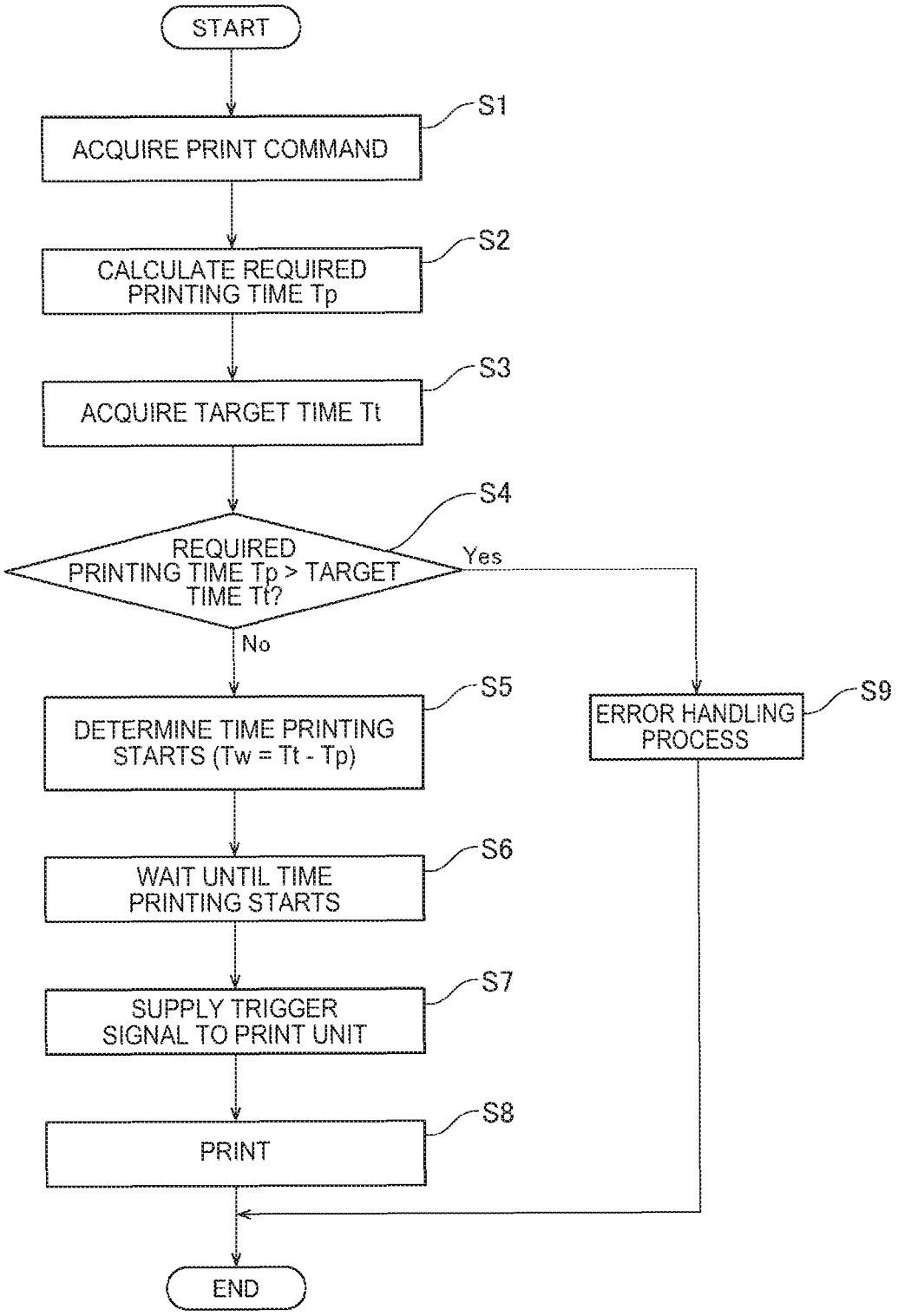
FIG. 5 is a flow chart of the printing process of the printer in FIG. 2.

FIG. 4 is a timing chart of the printing process of the printer 10. FIG. 5 is a flow chart of the printing process of the printer 10. When a print command is received from the control device 2 (step S1, print command acquisition step), the controller 12 of the printer 10 calculates the required printing time Tp, which is the time required to print specific content (step S2, required printing time calculation step). When a print command is acquired, the controller 12 also calculates or acquires the target time Tt for completing printing based on a detection signal output from the product detector 30 (step S3, target time acquisition step).

In step S3, the controller 12 acquires the detection signal output from the product detector 30. The controller 12 then reads the distance of travel L from the detection position B1 to the apply position B2, and the conveyance speed V of the product A, from the storage unit 18, and calculates the travel time L/V required for the product A to move from the detection position B1 to the apply position B2. Because the time required for the product A to reach the apply position B2 is target time Tt in this example, Tt=L/V. Note that instead of using the distance of travel L and conveyance speed V to calculate target time Tt each time, a previously calculated target time Tt=L/V may be stored in the storage unit 18, and the controller 12 may read the target time Tt from the storage unit 18 when triggered by acquiring the detection signal.

Next, based on the target time Tt and the required printing time Tp, the controller 12 determines if printing can be completed by the target time Tt (step S4, decision step). More specifically, in step S4, the controller 12 determines whether the target time Tt or the required printing time Tp is longer. If the required printing time Tp is less than or equal to the target time Tt (step S4: No), the controller 12 determines that printing can be completed by the target time Tt, and calculates the timing for starting printing (step S5, determine start printing time step) based on the target time Tt and the required printing time Tp. The controller 12 then waits until the time to start printing (step S6).

Steps S5 and S6 can be executed as follows. In step S5, the controller 12 calculates the standby time Tw until printing starts. This standby time Tw is calculated based on the target time Tt and the required printing time Tp, such as Tw=Tt−Tp. Next, in step S6, the controller 12 determines at a regular interval if the standby time Tw has past, and repeats this step until the standby time Tw is determined to have past.

If in step S4 the required printing time Tp is longer than the target time Tt (step S4: Yes), the controller 12 determines that printing cannot be completed by target time Tt and executes an error handling process (step S9, error handling step). The error handling process is a process that cancels the printing process instructed by the print commands, or a process that postpones the printing process instructed by the print commands.

In this embodiment, the print unit 11 starts printing based on a trigger signal supplied from the control device 2. The timing for starting printing is therefore the timing when the trigger signal is supplied from the controller 12 to the print unit 11. After waiting until the time to start printing in step S6, the controller 12 supplies the trigger signal to the print unit 11 (step S7). The print unit 11 then prints based on the received trigger signal (step S8).

When the process of steps S1 to S8 is executed, a printed label P1 is discharged from the printer 10 immediately before the product A reaches the apply position B2. The label applicator 20 the executes the operation of picking and applying the label P1 printed by the printer 10 to the product A.

Required Printing Time

In step S2, the controller 12 calculates the required printing time Tp, which is the time required to print the specified content, as the sum of the time T1 required for the print preparation operation setting up the print unit 11 for printing, and the time T2 required from the start to the completion of the printing operation. The time T2 from start to end of the printing operation is a time determined based on the printing instructed by the print commands. The time T1 required for the print preparation operation is determined by the state of the print unit 11, and is the time required from when the print unit 11 receives the trigger signal from the controller 12 until the print unit 11 is ready to start the printing operation.

When not printing, the controller 12 holds the print unit 11 in a standby mode. If a print command is acquired while the print unit 11 is in the standby mode, the controller 12 executes a print preparation operation that returns the print unit 11 from the standby mode to the printing mode. The print preparation operation in this example therefore includes a cap retracting operation that retracts the head cap 17 from the capping position capping the ink nozzle face of the inkjet head 13. The print preparation operation in this example also includes an indexing operation that conveys the print medium P the conveyance distance required to position the label P1 to be printed to the printing position of the inkjet head 13. If a print command is acquired while the print unit 11 is in the standby mode, the controller 12 includes in the time T1 required for the print preparation operation both the time required to retract the cap and the time required for the indexing operation.

Operational Effect

As described above, when a print command is acquired, a printer 10 and control method therefor according to the invention calculate a required printing time Tp including the time T1 required for the print preparation operation, and calculate the target time Tt at which the specified printing operation should end. Therefore, a trigger signal for starting printing can be supplied to the print unit 11 at the appropriate time by calculating back from the target time Tt. In addition to including the time required to print, the required printing time Tp is calculated to also include the time T1 required for the print preparation operation that is executed according to the current state of the print unit 11. The difference between the target time Tt and the time when printing is actually completed can therefore be shortened. For example, when a print command is received when the printer 10 is in a standby mode, the timing for starting printing can be determined with consideration for the delay in the completion of printing due to the print preparation operation.

By shortening the difference between the target time Tt and the time printing actually ends, label application failures due to the printed label P1 not being ready when it is time to apply the label P1 in the post-printing process (in this example, the step of applying the label P1 to the product A) to which the printed label P1 is passed can be suppressed. The need for operator intervention due to a label P1 not being applied can also be suppressed. Label waste resulting from application failures can also be suppressed. The printing process and post-printing process can therefore be made more efficient, the print and apply labelling operation is more efficient, and label P1 waste can be suppressed.

Because this embodiment of the invention calculates the target time Tt based on a detection signal from the product detector 30, the conveyance position of the product A can be accurately determined and the appropriate target time Tt can be calculated. The difference between the time when the product A reaches the apply position B2 and the target time Tt can therefore be reduced.

Because this embodiment of the invention executes an error handling process when it determines that printing cannot be completed by the target time Tt, creating a label P1 that becomes wasted because printing could not be completed in time can be prevented. Problems in the post-printing process resulting from printing being delayed can also be prevented.

Variations (1) The controller 12 of the printer 10 in the embodiment described above acquires the detection signal from a product detector 30, and based on the detection signal calculates the target time Tt or acquires the target time Tt from the storage unit 18. Alternatively, a configuration in which the control device 2 acquires the detection signal and calculates the target time Tt based on the detection signal, and the printer 10 acquires the target time Tt from the control device 2 through the communication unit 19, is also conceivable. In this case, the control device 2 may send the target time Tt with the print commands to the printer 10, or may send the target time Tt to the printer 10 triggered by acquiring the detection signal after transmitting the print commands.

(2) The embodiment described above includes the time required to retract the cap and the time required for the indexing operation in the time T1 required for the print preparation operation, but the content of the print preparation operation is not limited to these operations and may include various mechanical operations that are performed before the printing operation starts. For example, if the ink container is pressurized to supply ink, the time required for the pressurizing operation may be included.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a print unit configured to print on a print medium; and a control unit configured to control the print unit, and when a print command is acquired, calculate a required printing time including the time from the start to the end of the printing operation printing the specified content, and the time required for a print preparation operation setting the print unit to a state able to start the printing operation, as the time required to complete printing based on the print command, acquire a target time until printing controlled by the print command is completed, and start the print preparation operation based on the required printing time and the target time.

2. The printer described in claim 1, further comprising:

a communication unit;

the control unit acquiring the print command and the target time through the communication unit.

3. The printer described in claim 1, further comprising:

a communication unit configured to communicate with a detection unit configured to detect products on a conveyor line;

the print medium being labels applied to product conveyed on the conveyor line; and acquiring the detection signal of the detection unit through the communication unit, and calculating the target time based on the detection signal.

4. The printer described in claim 1, the control unit determining based on the required printing time if printing can be completed by the target time, and if printing cannot be completed by the target time, executing an error handling process of cancelling or postponing printing as instructed by the print command.

5. The printer described in claim 1, the print unit including an inkjet head and ahead cap configured to cap the ink nozzle face of the inkjet head; and the print preparation operation including a cap retracting operation of retracting the head cap from the position capping the ink nozzle face.

6. The printer described in claim 1, the print unit including a conveyance mechanism configured to convey the print medium; and the print preparation operation including a print medium indexing operation of the conveyance mechanism.

7. A control method of a printer having a print unit configured to print on a print medium, and a control unit configured to control the print unit, comprising:

a print command acquisition step of the control unit acquiring a print command;

a required printing time calculating step of calculating a required printing time including the time from the start to the end of the printing operation printing the specified content, and the time required for a print preparation operation setting the print unit to a state able to start the printing operation, as the time required to complete printing based on the print command;

a target time acquisition step of the control unit acquiring a target time until printing controlled by the print command is completed; and a printing start time determination step of the control unit determining the time to start the print preparation operation based on the required printing time and the target time.

8. The control method of a printer described in claim 7, the print medium being labels applied to product conveyed on a conveyor line; and the target time acquisition step including acquiring the detection signal of a detection unit that detects the product on the conveyor line, and calculating the target time based on the detection signal.

9. The control method of a printer described in claim 7, further comprising:

a decision step of determining based on the required printing time if printing can be completed by the target time; and an error handling step of the control unit cancelling or postponing printing as instructed by the print command if printing cannot be completed by the target time.

10. The control method of a printer described in claim 7, the required printing time calculating step including calculating the time required for one or both of a cap retracting operation of retracting a head cap from the position capping the ink nozzle face, and a print medium indexing operation of the conveyance mechanism that conveys the print medium, as the time required for the print preparation operation.

11. A method comprising:

acquiring a print command indication a printing operation printing a specified content;

calculating a required printing time including the time from the start to the end of the printing operation printing the specified content and the time required for a print preparation operation selling the print unit to a state able to start the printing operation;

acquiring a target time until printing the specified content is completed; and starting the print preparation operation based on the required printing time and the target time.

12. The method described in claim 11, wherein:

the print medium is labels being applied to product conveyed on a conveyor line; and the target time is calculated based on a detection signal of a detection unit that detects the product on the conveyor line.

13. The method described in claim 11 further comprising:

determining if printing the specified content can be completed by the target time based on the required printing time; and cancelling or postponing printing the specified content if it is determined that the printing the specified content cannot be completed by the target time.

14. The method described in claim 11, wherein:

the time required for the print preparation operation is a time required for a cap retracting operation of retracting a head cap from the position capping the ink nozzle face.

15. The method described in claim 11, wherein:

the time required for the print preparation operation is a time required for a print medium indexing operation conveyancing the print medium to a print position.

16. The method described in claim 11, wherein:

the time required for the print preparation operation includes a time required for a cap retracting operation of retracting a head cap from the position capping the ink nozzle face and a time required for a print medium indexing operation conveyancing the print medium to a print position.

* * * * *